US005976023A

United States Patent [19]

Cho

[11] Patent Number: 5,976,023

[45] Date of Patent: Nov. 2, 1999

[54] COLLAPSIBLE GOLF NET

[75] Inventor: Kwang H. Cho, Los Angeles, Calif.

[73] Assignee: Anthony G. Macaluso, Escondido, Calif.

[21] Appl. No.: 09/020,782

[22] Filed: Feb. 9, 1998

[51] Int. Cl.[6] ..... A63B 69/36

[52] U.S. Cl. ..... 473/197; 273/400

[58] Field of Search ..... 273/400, 402, 273/398, 395; 473/197, 478, 434, 454

[56] References Cited

U.S. PATENT DOCUMENTS

| | | | |
|---|---|---|---|
| 5,088,740 | 2/1992 | Peterson | 473/197 |
| 5,427,381 | 6/1995 | Macaluso et al. . | |
| 5,433,433 | 7/1995 | Armell | 273/400 |
| 5,569,094 | 10/1996 | Macaluso . | |
| 5,816,954 | 10/1998 | Zheng | 273/400 |
| 5,823,885 | 10/1998 | Stempfer | 473/197 |
| 5,842,940 | 12/1998 | Macaluso | 473/197 |

*Primary Examiner*—Mark S. Graham
*Attorney, Agent, or Firm*—Lynn & Lynn

[57] ABSTRACT

A self-erecting collapsible net for stopping the flight of projectiles such as a golf ball, the collapsible net comprising: (a) a closed loop resilient coilable member having a perimeter; (b) a fabric portion attached to at least a portion of the perimeter of the coilable member to stop a projectile impelled thereon; and (c) support means comprising at least one support member extending from a portion of the perimeter of the coilable member, the support member including a stake bore protruding therein, the stake bore being sized and shaped to receive a stake capable of being placed in a stake pocket in a substantially horizontal surface. The collapsible net can be expanded and disposed on said surface with one end of the stake introduced into the stake bore in the support member, and another end of the stake introduced into a stake pocket in said surface, thereby erecting the collapsible net in a substantially uprightly position such that the plane of the fabric is substantially transverse to said surface.

14 Claims, 3 Drawing Sheets

COLLAPSIBLE GOLF NET

BACKGROUND

The present invention related to collapsible nets, and, in particular, to collapsible golf nets for stopping the flight of golf balls.

Various sports such as golf, involve hitting or throwing a projectile such as a golf ball in a desired direction in a field. For practice purposes, it is desirable to capture the ball before it travels a large distance or strikes objects or people. Existing capturing structures include a net attached to the perimeter of a capturing frame and a rigid support frame attached to the capturing frame. The support frame is attached to the capturing frame and provides a base allowing the capturing structure to be disposed on the ground.

A disadvantage of such structure is that they cannot be easily folded and efficiently stored. This is because both the support frame and the capturing frame must be properly folded and placed in a container. Further use of a capturing frame and a supporting frame makes such structures more expensive to manufacture and harder to carry due to increased weight.

There is, therefore, a need for a golf net which can be easily folded and efficiently stored in a container. There is also a need for such a golf net to be self-erecting and easy to carry.

SUMMARY

The present invention satisfies these needs. In one embodiment, the present invention provides a self-erecting collapsible net for stopping the flight of projectiles such as a golf ball. The collapsible net comprises: (a) a closed loop resilient coilable member having a perimeter; (b) a fabric portion attached to at least a portion of the perimeter of the coilable member to stop a projectile impelled thereon; and (c) support means comprising at least one support member extending from a portion of the perimeter of the coilable member, the support member including a stake bore protruding therein, the stake bore being sized and shaped to receive a stake capable of being placed in a stake pocket in a substantially horizontal surface. The collapsible net can be expanded and disposed on said surface with one end of the stake introduced into the stake bore in the support member, and another end of the stake introduced into a stake pocket in said surface, thereby erecting the collapsible net in a substantially uprightly position such that the plane of the fabric is substantially transverse to said surface.

When the net is collapsed, the coilable member forms overlapping loops over one another that can be coiled. The coilable member can be substantially rectangular in shape, and continuous. The coilable member can include two ends and a connector for connecting the two ends to form a closed loop, the connector comprising a substantially cylindrical shell having a pocket at each end, each pocket receiving and holding an end of the coilable member, at least one of the pockets allowing an end of the coilable member to axially rotate in the shell.

Preferably, the support means comprises a first support member and a second support member, the support members extending from portions of opposite sides of the perimeter of the coilable member. Each support member includes a stake bore protruding therein, the stake bore being sized and shaped to receive a stake capable of being placed in a stake pocket in a substantially horizontal surface. The collapsible net can be expanded and disposed on said surface by: (i) introducing an end of a first stake into the stake bore in the first support member, and another end of the first stake introduced into a first stake pocket in said surface, and (ii) introducing an end of a second stake into the stake bore in the second support member, and another end of the second stake introduced into a second stake pocket in said surface; thereby erecting the collapsible net in a substantially uprightly position such that the plane of the fabric is substantially transverse to said surface.

Each support member can comprise a flexible hollow member sized and shaped to receive and snugly hold at least a portion of a stake therein. The support means can further comprise at least one flexible strap having an end attached to a portion of the perimeter of the coilable member, and a free end for attachment to said horizontal surface. The net can further comprise at least one cross strap having two ends, each end connected to a portion of the perimeter of the coilable member to maintain a selected angular profile for the coilable member in the expanded position.

DRAWINGS

These and other features, aspects and advantages of the present invention will become better understood with regard to the following description, appended claims and accompanying drawings where:

DESCRIPTION

Figure 1:
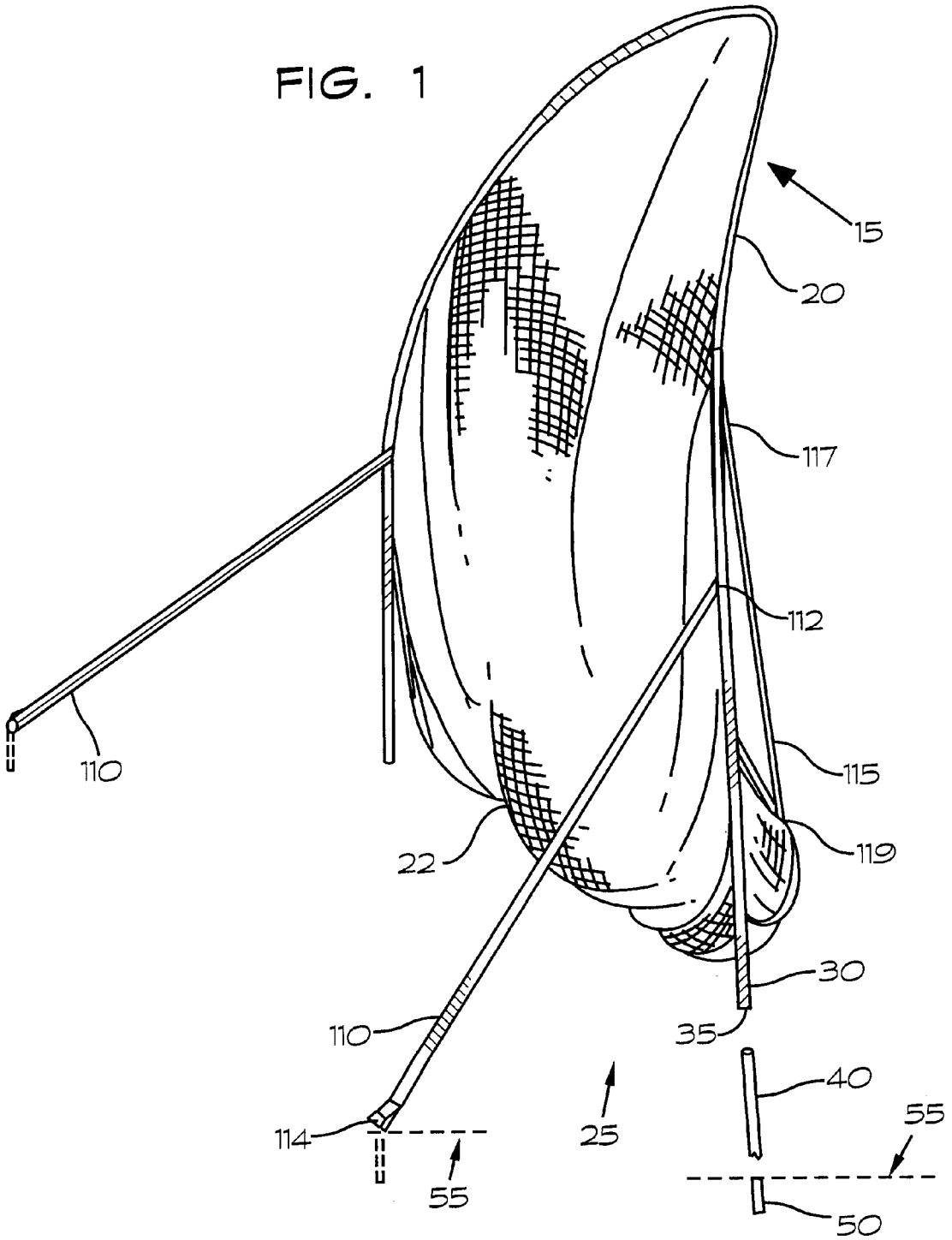
FIG. 1 is a rear perspective view of an embodiment of a self-erecting collapsible net according to the present invention shown in expanded configuration.

Referring to the drawings, an embodiment of a selferecting collapsible net 10 for stopping the flight of projectiles such as a golf ball according to the present invention comprises: (a) a closed loop resilient coilable member 15 having a perimeter 20; (b) a fabric portion 22 attached to at least a portion of the perimeter 20 of the coilable member 15 to stop a projectile impelled thereon; and (c) support means 25 comprising at least one support member 30 extending from a portion of the perimeter 20 of the coilable member 15, the support member 30 including a stake bore 35 protruding therein, the stake bore 35 being sized and shaped to receive a stake 40 capable of being placed in a stake pocket 50 in a substantially horizontal surface 55 such a ground. The collapsible net 10 can be expanded and disposed on said surface 55 with one end of the stake 40 introduced into the stake bore 35 in the support member 30, and another end of the stake 40 introduced into a stake pocket 50 in said surface 55, thereby erecting the collapsible net 10 in a substantially uprightly position such that the plane of the fabric 22 is substantially transverse to said surface 55.

When the net 10 is collapsed, the coilable member 15 forms overlapping loops over one another that can be coiled. The coilable member 15 can be substantially rectangular in shape, and continuous. The coilable member 15 can include two ends 60 and a connector 65 for connecting the two ends 60 to form a closed loop, the connector 65 comprising a substantially cylindrical shell having a pocket at each end, each pocket receiving and holding an end of the coilable member 15, at least one of the pockets allowing an end 60 of the coilable member 15 to axially rotate in the shell.

The coilable member 15 can be from about 10 feet to about 25 feet long in perimeter, and can be substantially rectangular, elliptical, circular or other shapes as desired. The coilable member 15 has sufficient flexibility to allow distortion into overlapping loops. The coilable member 15 can be a sheet or spring steel stock covered by a sleeve. Such material tends to resiliently urge itself back towards its resting position.

The fabric 22 can be made from flexible materials such as cotton, having a surface area sufficient to at least cover the entire area of the coilable member 15. Preferably, the fabric 22 has a surface area sufficient to provide slack in the fabric 22 when the net 10 is in its fully erected position. The fabric 22 can be from about 5 square feet to about 300 square feet in its area. Much larger surface area of the fabric 22 is possible with the stronger and stiffer coilable member 15. The fabric 22 can be attached to the perimeter 20 of the coilable member 15 by stitching for example.

The support means 25 can comprise a first support member 70 and a second support member 75. The support members 70, 75 extend from portions of opposite sides 45 of the perimeter 20 of the coilable member 15, with each support member including a stake bore 35 protruding therein. Each stake bore 35 is sized and shaped to receive a stake 40 capable of being placed in a stake pocket 50 in a substantially horizontal surface 55. The collapsible net 10 can be expanded and disposed on said surface 55 by: (i) introducing an end of a first stake 80 into the stake bore 35 in the first support member 70, and another end of the first stake 80 introduced into a first stake pocket 100 in said surface 55, and (ii) introducing an end of a second stake 85 into the stake bore 35 in the second support member 75, and another end of the second stake 85 introduced into a second stake pocket 105 in said surface 55. As such, the collapsible net 10 can be erected in a substantially uprightly position such that the plane of the fabric 22 is substantially transverse to said surface 55.

Each support member 70, 75 can comprise a flexible hollow member sized and shaped to receive and snugly hold at least a portion of a stake 40 therein. Preferably, each hollow member comprises a tube 120 with an end 125 attached to a portion of the perimeter 20 of the coilable member 15, and a free end 130 for receiving a stake. Each tube 120 can be attached to the perimeter 20 of the coilable member 15 by stitching for example. Each tube 120 can be made from a flexible material such as fabrics.

Each tube 120 can be from about 1 foot to about 4 feet long, and have a diameter from about 0.5 inch to about 5 inches. In the embodiment of the tent 10 shown in the drawings, each tube 120 is attached to an opposite side 45 of the perimeter 20 of the coilable member 15 about mid portion of the vertical height of the net 10 in its erected position as shown. Each tube 120 can also be attached to the perimeter 20 higher or lower along the vertical height of the tent 10. Preferably, each tube 20 is attached to the perimeter 20 of the coilable member 15 along a substantial portion of the length of the tube 120 as shown. Each stake 40 is sufficiently long to fill at least a portion of each tube 20. The diameter of each stake 20 is such as to snugly fit within each tube 120.

The support means 25 can further comprises at least one flexible strap 110 having an end 112 attached to the perimeter 20 of the coilable member 15, and a free end 114 for attachment to said horizontal surface 55. Preferably, the support means 25 further comprises, two flexible straps 110, each strap having an end 112 attached to the perimeter 20 of the coilable member 15, and a free end 114 for attachment to said horizontal surface 55.

The net 10 can further comprise at least one cross strap 115 having two ends 117, 119 each end connected to a portion of the coilable member 15 to maintain a selected angular profile for the coilable member 15 in the expanded position. Preferably, the net 10 comprises two cross straps 115 each having two ends 117, 119, each end connected to a portion of the perimeter 20 of the coilable member 15 to maintain a selected angular profile for the coilable member 15 in the expanded position.

When collapsing the net 10, the coilable member 15 is rotated along its perimeter 20 to form loops which are placed on top of one another along their perimeters in a planar form. The loops are stable for handling such as placement inside a carrying case shaped and sized to receive the loops and snugly fit around the loops.

To erect the net 10, the coilable member 15 is released from its carrying case and upon release the coilable member 15 returns to its expanded shape, erecting the net 10 into the form shown in the drawings. Two stakes pockets 100, 105 are formed in the ground, and an end of a first stake 80 is introduced into the open end of the first tubular support member 70, and another end of the first stake 80 is introduced into the first stake pocket 100. Next, an end of a second stake 85 into the open end of the second tubular support member 75, and another end of the second stake 85 introduced into the second stake pocket 105. The flexible straps 110 are then attached to the ground by for example attaching them to support stakes inserted into the ground.

Figure 3:
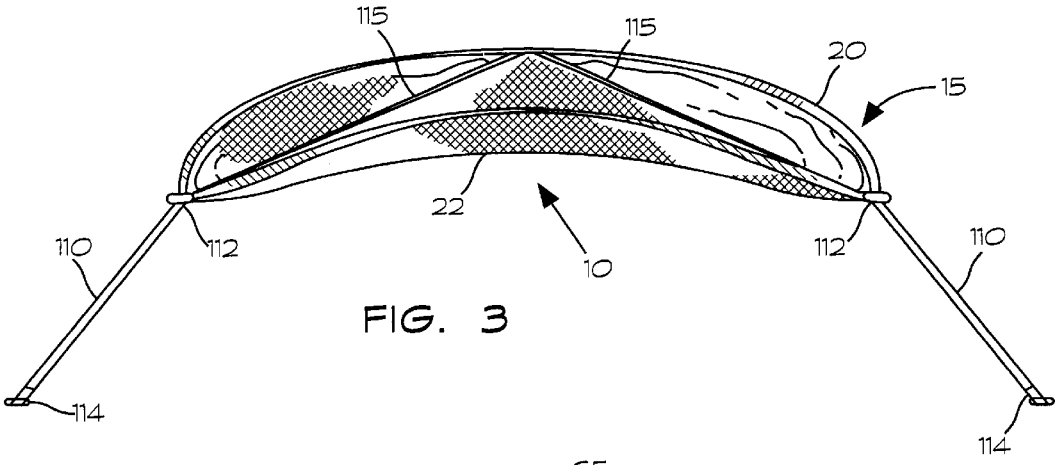
FIG. 3 is a rear view of the net of FIG. 1.
Figure 2:
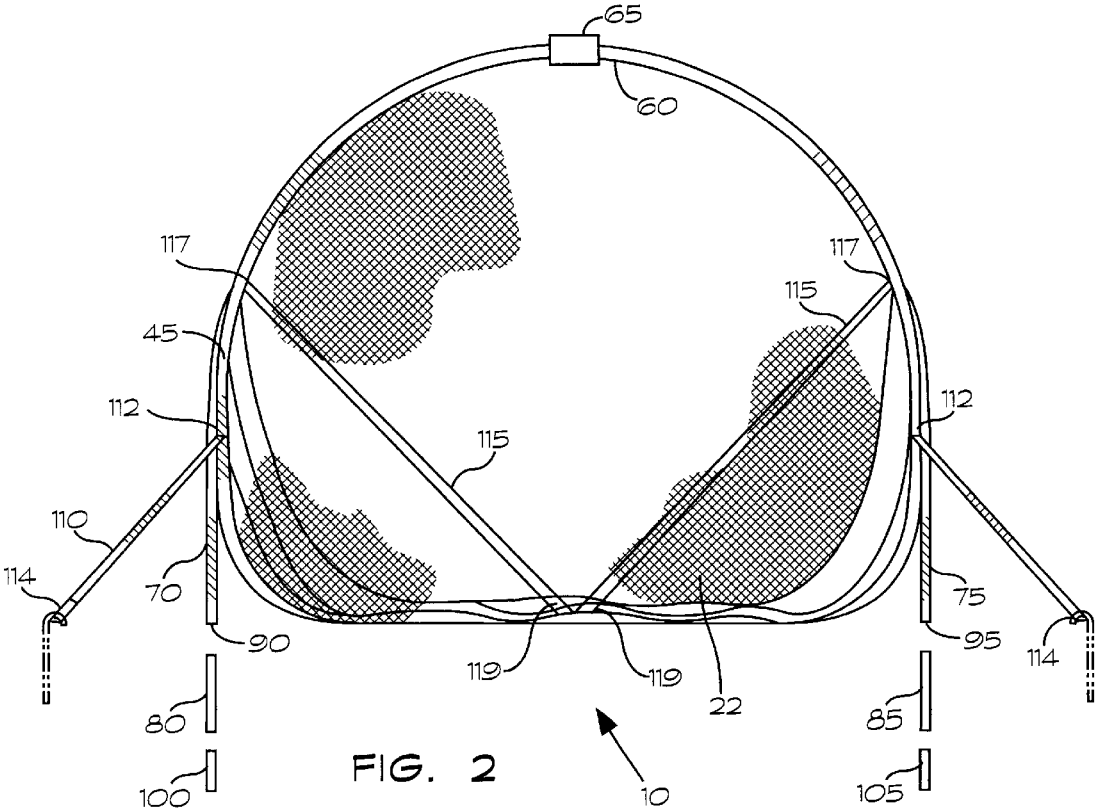
FIG. 2 is a top view of the net of FIG. 1.
Figure 5:
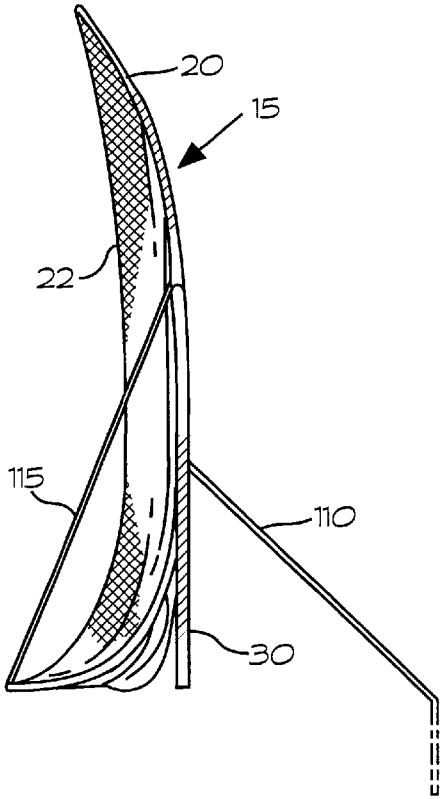
FIG. 5 is a side view of the net of FIG. 1.
Figure 4:
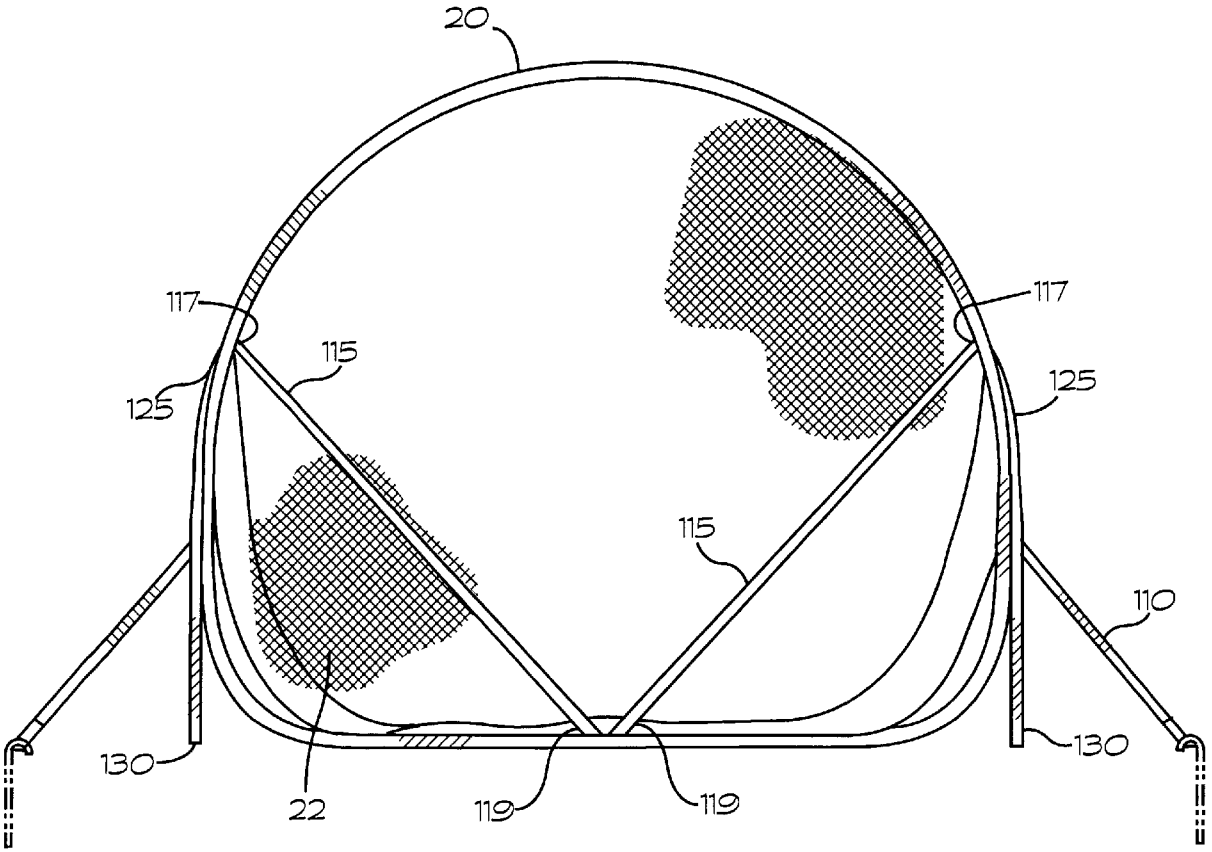
FIG. 4 is a front view of the net of FIG. 1.

The collapsible net 10 is thereby erected in a substantially uprightly position such that the plane of the fabric 22 is substantially transverse to the ground, whereby the fabric 22 can stop projectiles such as golf balls impelled thereon. FIGS. 1–5 show the erected net 10 in perspective, top, rear, front and side views, respectively.

Although the present invention has been described in considerable detail with regard to the preferred versions thereof, other versions are possible. Therefore, the appended claims should not be limited to the descriptions of the preferred versions contained herein.

What is claimed is:

1. A self-erecting collapsible net for stopping the flight of a projectile such as a golf ball, the collapsible net comprising:

(a) a closed loop resilient coilable member having a perimeter;

(b) a fabric portion attached to at least a portion of the perimeter of the coilable member to stop a projectile impelled thereon; and (c) support means comprising at least one support member extending from a portion of the perimeter of the coilable member, the support member including a stake bore protruding therein, the stake bore being sized and shaped to receive a stake capable of being placed in a stake pocket in a substantially horizontal surface, the support member comprising a flexible hollow member sized and shaped to receive and snugly hold at least a portion of a stake therein wherein the collapsible net can be expanded and disposed on said surface with one end of the stake introduced into the stake bore in the support member, and another end of the stake introduced into a stake pocket in said surface, thereby erecting the collapsible net in a substantially uprightly position such that the plane of the fabric portion is substantially transverse to said surface.

2. The collapsible net of claim 1, wherein the support means further comprises at least one flexible strap having an end attached to a portion of the perimeter of the coilable member, and a free end for attachment to said horizontal surface.

3. The collapsible net of claim 1, wherein when the net is collapsed, the coilable member forms overlapping loops over one another that can be coiled.

4. The collapsible net of claim 1, wherein the coilable member is substantially rectangular in shape.

5. The collapsible net of claim 1, wherein the coilable member is continuous.

6. The collapsible net of claim 1, wherein the coilable member includes two ends and a connector for connecting the two ends to form a closed loop, the connector comprising a substantially cylindrical shell having a pocket at each end, each pocket receiving and holding an end of the coilable member, at least one of the pockets allowing an end of the coilable member to axially rotate in the shell.

7. The collapsible net of claim 1, further comprising at least one cross strap having two ends, each end connected to a portion of the perimeter of the coilable member to maintain a selected angular profile for the coilable member in the expanded position.

8. A self-erecting collapsible net for stopping the flight of projectiles such as a golf ball, the collapsible net comprising:

(a) a closed loop resilient coilable member having a perimeter;

(b) a fabric portion attached to at least a portion of the perimeter of the coilable member to stop a projectile impelled thereon; and (c) support means comprising a first tubular support member and a second tubular member, the support members extending from portions of opposite sides of the perimeter of the coilable member, each support member including a stake bore protruding therein, the stake bore being sized and shaped to receive a stake capable of being placed in a stake pocket in a substantially horizontal surface, wherein, the collapsible net can be expanded and disposed on said surface by: (i) introducing an end of a first stake into the stake bore in the first support member, and another end of the first stake introduced into a first stake pocket in said surface, and (ii) introducing an end of a second stake into the stake bore in the second support member, and another end of the second stake introduced into a second stake pocket in said surface;

thereby erecting the collapsible net in a substantially uprightly position such that the plane of the fabric portion is substantially transverse to said surface.

9. The collapsible net of claim 8, wherein the support means further comprises at least one flexible strap having an end attached to a portion of the perimeter of the coilable member, and a free end for attachment to said horizontal surface.

10. The collapsible net of claim 9, wherein when the net is collapsed, the coilable member forms overlapping loops over one another that can be coiled.

11. The collapsible net of claim 10, further comprising at least one cross strap having two ends, each end connected to a portion of the perimeter of the coilable member to maintain a selected angular profile for the coilable member in the expanded position.

12. The collapsible net of claim 8, wherein the coilable member is continuous.

13. The collapsible net of claim 8, wherein the coilable member includes two ends and a connector for connecting the two ends to form a closed loop, the connector comprising a substantially cylindrical shell having a pocket at each end, each pocket receiving and holding an end of the coilable member, at least one of the pockets allowing an end of the coilable member to axially rotate in the shell.

14. The collapsible net of claim 13, wherein the coilable member is substantially rectangular in shape.

* * * * *